US011464324B2

(12) United States Patent
Tucker

(10) Patent No.: US 11,464,324 B2
(45) Date of Patent: Oct. 11, 2022

(54) PAINT BRUSH HOLDER

(71) Applicant: Warren Tucker, Carson City, NV (US)

(72) Inventor: Warren Tucker, Carson City, NV (US)

( * ) Notice: Subject to any disclaimer, the term of this patent is extended or adjusted under 35 U.S.C. 154(b) by 80 days.

(21) Appl. No.: 16/404,980

(22) Filed: May 7, 2019

(65) Prior Publication Data

US 2020/0352318 A1 Nov. 12, 2020

(51) Int. Cl.
*A46B 17/02* (2006.01)
*B44D 3/12* (2006.01)

(52) U.S. Cl.
CPC ..... *A46B 17/02* (2013.01); *A46B 2200/202* (2013.01); *B44D 3/123* (2013.01)

(58) Field of Classification Search
CPC ..... A46B 5/02; A46B 5/021; A46B 5/025; A46B 17/02; A46B 2200/202; B44D 3/123; B25G 1/102; B25G 1/06; B25G 1/00; B25G 1/10; B25G 1/063; B25G 1/066; B25G 3/00; B25G 3/02; B25G 1/005; B25G 1/007; B25G 3/04; B25G 3/06
USPC ..... 84/489, 177.5; 16/422, 426, 42, 430; 220/697
See application file for complete search history.

(56) References Cited

U.S. PATENT DOCUMENTS 1,391,017 A * 9/1921 Sohnle ..... A46B 17/02 403/4
2,788,153 A * 4/1957 Broadbelt ..... B44D 3/14 220/759
5,253,768 A * 10/1993 Traversa ..... B44D 3/123 248/110
5,499,637 A * 3/1996 Foti ..... A46B 5/00 15/160
5,853,157 A * 12/1998 O'Donnell ..... B44D 3/123 248/113
5,860,190 A * 1/1999 Cano ..... A47G 21/02 16/422
5,991,956 A * 11/1999 Chapman ..... A46B 17/02 15/145
6,922,864 B2 * 8/2005 Clarke ..... B25G 1/085 7/143
7,278,668 B1 * 10/2007 Simmons ..... B25G 1/102 294/25
8,261,638 B2 * 9/2012 Hsu ..... B25B 13/06 81/177.2

(Continued)

FOREIGN PATENT DOCUMENTS

WO WO-02051286 A1 * 7/2002 ..... A46B 17/02

OTHER PUBLICATIONS

Rita Crompton, Paint Mate: A New Ergonomic Paint Brush Handle, Sep. 4, 2017, internet available at https://www.inventorlady.com/project/paint-brush-ergonomic-paint-mate/ (Year: 2017).*

(Continued)

*Primary Examiner* — Joshua E Rodden
(74) *Attorney, Agent, or Firm* — Jonathan B. David

(57) ABSTRACT

A paint brush holder that can provide easier and more effective use of a paint brush is described herein. The holder includes one or more bores that can admit insertion of a paint brush handle, and can include further features that add functionality. With a paint brush inserted into the holder, a user can paint with better control and for longer periods with less fatigue as compared to painting with a brush alone.

19 Claims, 4 Drawing Sheets

(56) References Cited

U.S. PATENT DOCUMENTS

| | | | | |
|---|---|---|---|---|
| 8,468,700 | B2 * | 6/2013 | Wilson | B26B 5/00 83/13 |
| 9,032,580 | B2 * | 5/2015 | Freuler | A46B 5/00 15/143.1 |
| 9,630,311 | B2 * | 4/2017 | Creelman | B44D 3/123 |
| 9,815,319 | B2 * | 11/2017 | Cooper | B44D 3/14 |
| D807,693 | S * | 1/2018 | Obmaces | D7/393 |
| 9,931,745 | B2 * | 4/2018 | Freuler | B25G 1/102 |
| 10,384,337 | B2 * | 8/2019 | Ashmead | B25G 3/10 |
| 10,449,663 | B2 * | 10/2019 | Martin | A46B 17/02 |
| 10,709,273 | B1 * | 7/2020 | Lynn | B43L 15/00 |
| 11,117,419 | B2 * | 9/2021 | Herbert | B44D 3/123 |
| 2005/0261784 | A1 * | 11/2005 | Erb | A61F 2/583 81/177.1 |
| 2006/0113310 | A1 * | 6/2006 | Hawkins | B44D 3/123 220/736 |
| 2012/0167348 | A1 * | 7/2012 | Adams | B25G 1/102 16/426 |
| 2013/0061428 | A1 * | 3/2013 | Freuler | B65G 1/00 16/400 |
| 2014/0310917 | A1 * | 10/2014 | Harvey | B25G 1/102 16/421 |
| 2015/0034777 | A1 * | 2/2015 | Ionis | B44D 3/123 248/113 |
| 2015/0089756 | A1 * | 4/2015 | Verzino, Jr. | A46B 17/02 15/145 |
| 2019/0255691 | A1 * | 8/2019 | Paulsen | B25D 1/02 |
| 2019/0299389 | A1 * | 10/2019 | Tsai | B25B 23/0007 |
| 2021/0237504 | A1 * | 8/2021 | Turner | B44D 3/123 |
| 2021/0321758 | A1 * | 10/2021 | Halaska | A46B 5/02 |

OTHER PUBLICATIONS

Rita Crompton, Paint Mate: A New Ergonomic Paint Brush Handle, Sep. 4, 2017, internet available at https://www.inventorlady.com/project/page/4/ (Year: 2017).*

* cited by examiner

PAINT BRUSH HOLDER

BACKGROUND

The present invention relates generally to tools for painting. More particularly, the present invention relates to tools that aid in the use of existing paint brushes and the like.

Painting or similar tasks involving the use of a paint brush, particularly over extended periods, can cause significant user fatigue. This is partly due to the repetitive back-and-forth movement of the user's wrist that such tasks require. In addition, achieving desired aesthetic results from painting often requires that a degree of precision is used so that the paint or other coating is applied in specific places while avoiding nearby surfaces. This level of precision typically involves using the thumb and fingers to apply force on the bristles and/or ferrule, so as to generate controlled movement and placement of the bristles on the surface being painted. Due to the shape of most paint brushes, this method often deprives the user of the leverage that would have been gained by gripping the handle of the paint brush, thus accelerating the fatigue experienced in the thumb and fingers. Even for painting tasks where gripping the brush handle is feasible, most paint brush handles are too narrow to provide a comfortable grip, which also contributes to fatigue. Furthermore, the orientation of the surface to be painted often requires that the user's hand holds the paint brush at an uncomfortable angle with respect to the user's wrist, also contributing to fatigue and possible repetitive stress injuries.

SUMMARY OF THE INVENTION

Briefly, and in general terms, the invention is directed to a holder for a paint brush, said holder having a body with an oblong shape and a first end and a second end; a bore completely penetrating the body transversely near the first end, with the diameter of said bore being sufficient to allow insertion of a paint brush handle; and at least one notch situated near the second end.

In embodiments of the invention, the holder can include additional bores near the bore.

In another embodiment of the invention, a holder can include a hammer head attached to an end of the body. In a more particular embodiment, the attachment of the hammer head can be a removable attachment.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein:

FIG. 2 show perspective views of a paint brush holder in accordance with an embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION

In describing embodiments of the present invention, the following terminology will be used.

The singular forms "a," "an," and "the" include plural referents unless the context clearly dictates otherwise. Thus, for example, reference to "a needle" includes reference to one or more of such needles and "etching" includes one or more of such steps.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "50-250 centimeters should be interpreted to include not only the explicitly recited values of about 50 centimeters and 250 centimeters, but also include individual values and sub-ranges within the indicated range. Thus, included in this numerical range are individual values such as 60, 70, and 80 centimeters, and sub-ranges such as from 50-100 centimeters, from 100-200, and from 100-250 centimeters, etc. This same principle applies to ranges reciting only one numerical value and should apply regardless of the breadth of the range or the characteristics being described.

As used herein, the term "about" means that dimensions, sizes, formulations, parameters, shapes and other quantities and characteristics are not and need not be exact, but may be approximated and/or larger or smaller, as desired, reflecting tolerances, conversion factors, rounding off, measurement error and the like and other factors known to those of skill. Further, unless otherwise stated, the term "about" shall expressly include "exactly," consistent with the discussion above regarding ranges and numerical data.

Figure 1:
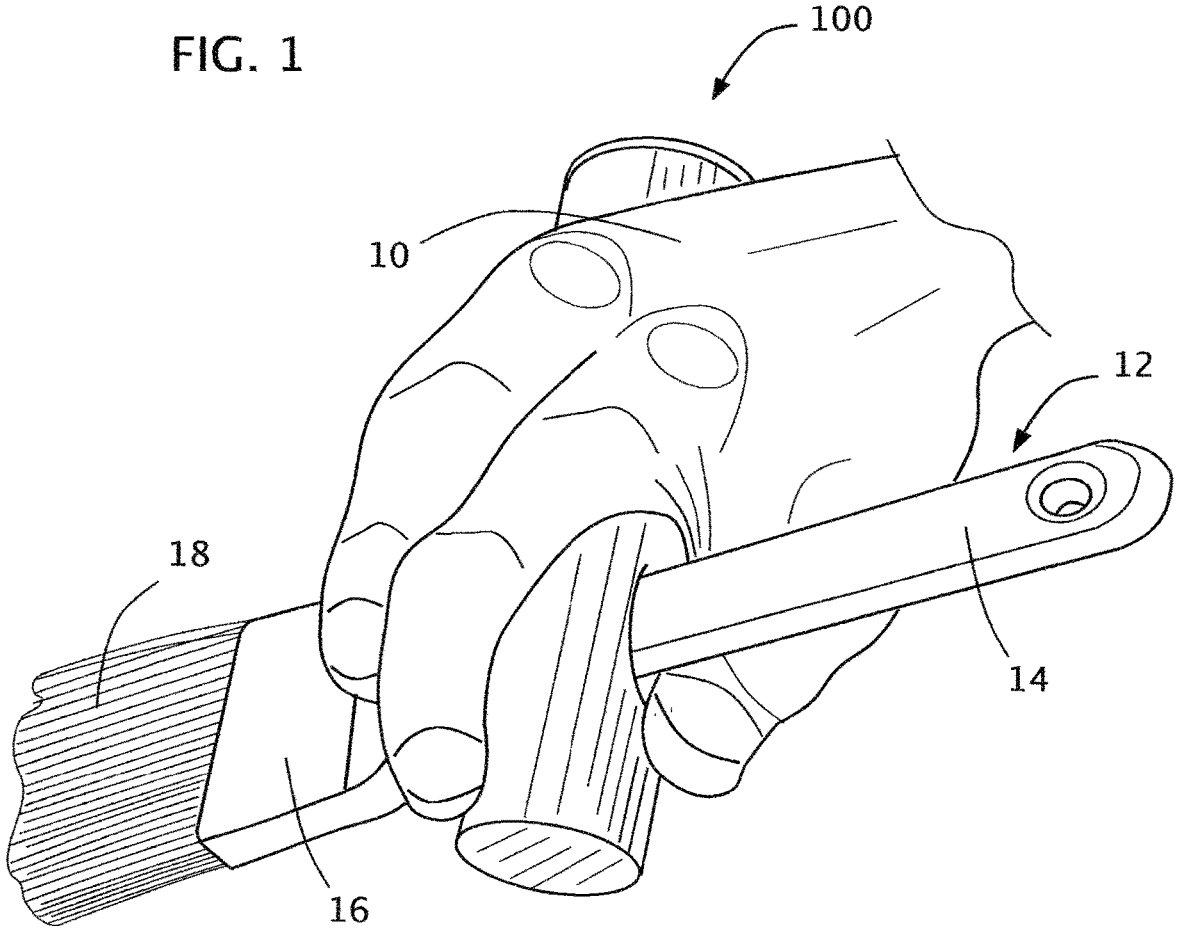
FIG. 1 is a view of a contemplated use of a paint brush holder in conjunction with a paint brush in accordance with the present invention.

FIG. 1 shows an illustration of a contemplated use of a paint brush holder 100 in accordance with the present invention, particularly how the holder 100 can be held in a user's hand 10 during painting. In a particular aspect, the holder 100 provides a gripping surface can be functionally connected to a paint brush 12 being used to paint by insertion of the handle 14 into the holder 100. In a particular aspect, the holder 100 has a size and shape that is easier to grip than a typical paint brush handle; as such, gripping the holder results in less of the discomfort and fatigue that is typically attendant with long periods of painting with a paint brush. In another particular aspect, the holder increases the gripping surface available to the user for controlling the movement of the brush during painting. For example, the holder can rest in the palm of the hand or in the saddle between the thumb and forefinger, while the fingers are extended toward or on the ferrule 16. In this way, the holder can be employed in controlling the general orientation of the brush and the general direction of brush strokes, while the fingertips can be employed in finer control of the location of the bristles 18.

Figure 2A:
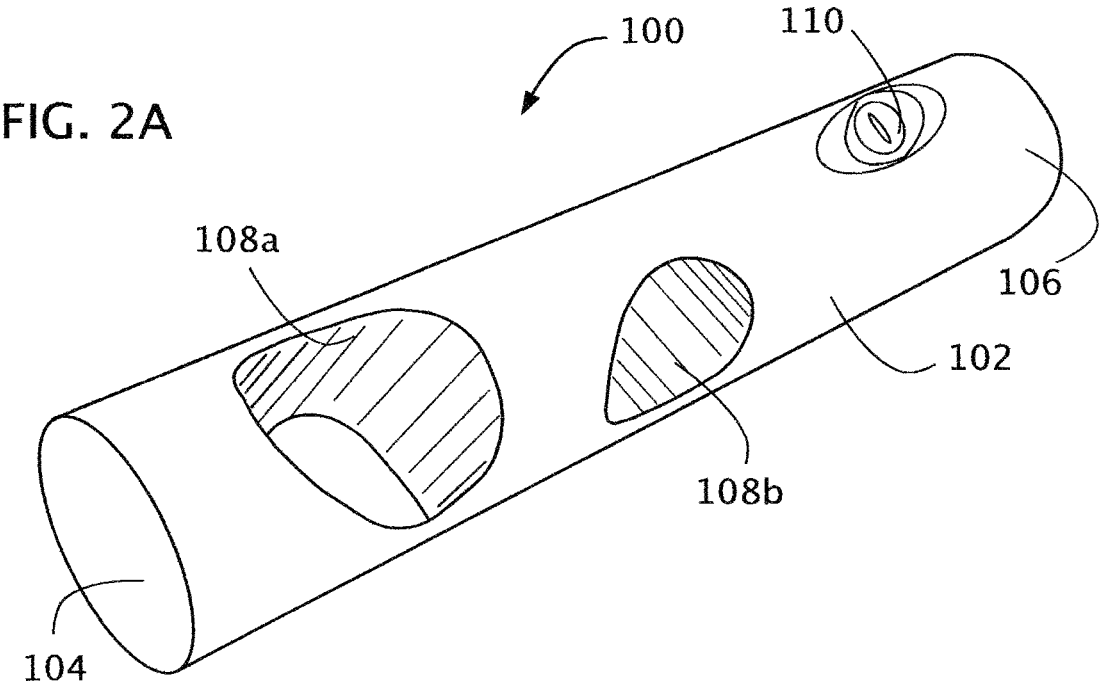
FIG. 2A is a perspective view from a first end of the holder.
Figure 2B:
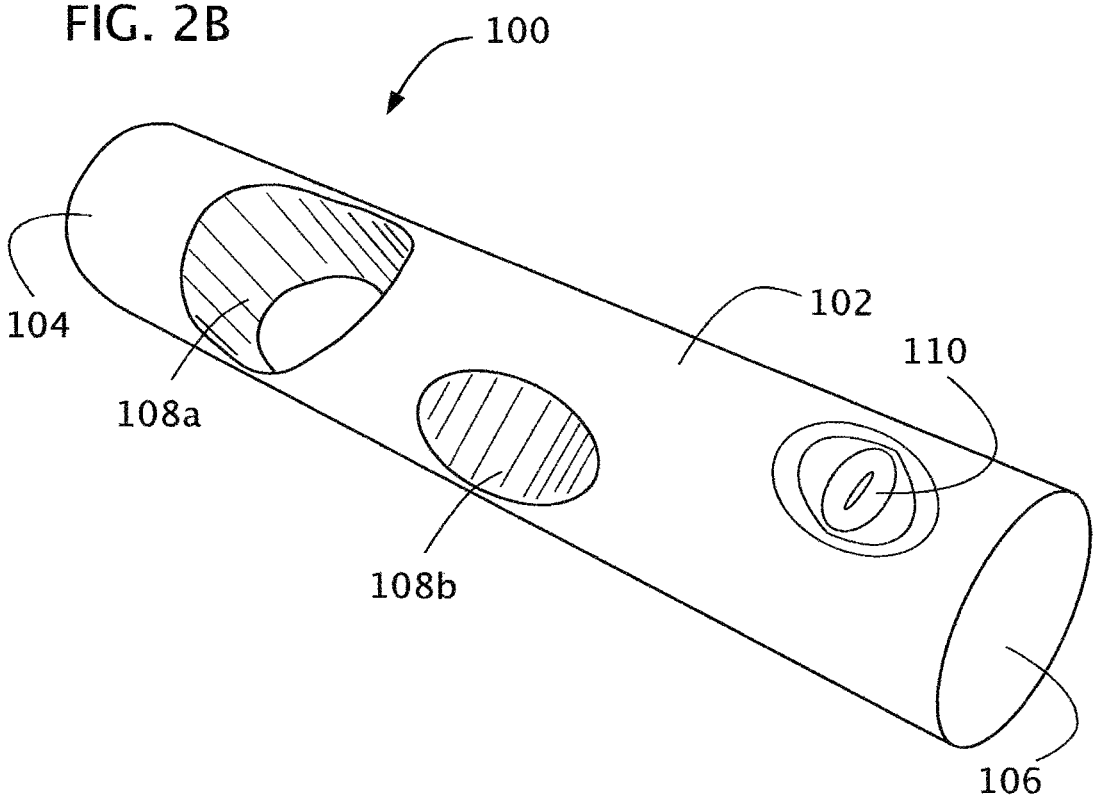
FIG. 2B is another perspective view from the opposite end.

Further detail of an embodiment of the present invention is shown in FIGS. 2A and 2B, in which a holder 100 for a paint brush according to the present invention can comprise a body 102 with an oblong shape and having a first end 104 and a second end 106. At least one bore 108*a* is present to provide for insertion of the handle of a paint brush. As such the bore 108*a* completely transversely penetrates the body 102 so that said paint brush handle can be inserted sufficiently to bring the broad part of the brush and/or ferrule into proximity to the body. Therefore in a particular aspect, the bore 108*a* is of a sufficient internal diameter to admit the handle of a paint brush to be used with the holder 100.

A preferred use of the holder is insertion of a paint brush handle into a bore such that there exists a reasonable match between the cross-section of the handle and the diameter of the bore. In this way an amount of contact can be maintained between the inner surface of the bore and the brush handle during use that the user can maintain sufficient control over the position of the brush for accurate painting. The orientation of the bore with respect to the body 102 is such that a paint brush inserted therein extends at an angle relative to the body that is effective for use. In a particular embodiment, this angle is approximately a right angle, i.e. about 90 degrees.

Furthermore, it is contemplated that a painting task may require the use of different paint brushes of differing sizes. For example, a broad brush may be used for covering the larger surfaces to be painted, while a smaller brush is used for smaller areas or more detailed surfaces that require more precise application of paint. Accordingly, in a particular embodiment, the holder 100 can include more than one bore. A holder 100 having two bores, a bore 108*a* and a second bore 108*b*, is shown in FIGS. 2A and 2B by way of example. However it is recognized that a holder 100 can comprise additional bores, e.g. so as to total three or four bores, in accordance with the embodiment. A more particular aspect of the embodiment, the plurality of bores can have different diameters suitable for insertion and use with a variety of differently sized paint brushes. In a more particular embodiment, the second bore can have an orientation that is at some nonzero angle to that of the bore, said angle being with respect to the longitudinal axis of the body. In another particular embodiment, at least one bore is oriented substantially perpendicularly to a longitudinal axis of the body The size and shape of the body 102 is also of significance for the intended use of the present invention. An aspect of the invention is a shape that accommodates grasping the holder 100 in the hand. In another aspect, the shape of the holder 100 can be such that it extends far enough into the user's hand for effective leverage to enhance control of the paint brush. In a preferred embodiment, the body 102 is oblong in shape. The body 102 can also be such that it facilitates easy gripping of the holder 100 in the user's hand. This can include various cross-sectional shapes, such as generally elliptical and circular in particular, generally rectangular and square in particular, triangular, or non-rectangular polygonal forms having from 5 to 20 sides. In a particular embodiment, the body 102 has a substantially circular cross-section. In a specific embodiment, the body 102 is substantially cylindrical in shape.

The body 102 can comprise a material suited to the contemplated use, and particularly the material can be chosen to provide sufficient durability without contributing excessive weight. In a particular embodiment, the body 102 can comprise a material such as wood, rubber, plastic, or aluminum. In accordance with the present invention, the body 102 can have a substantially solid construction, or alternatively may be substantially hollow.

Figure 3:
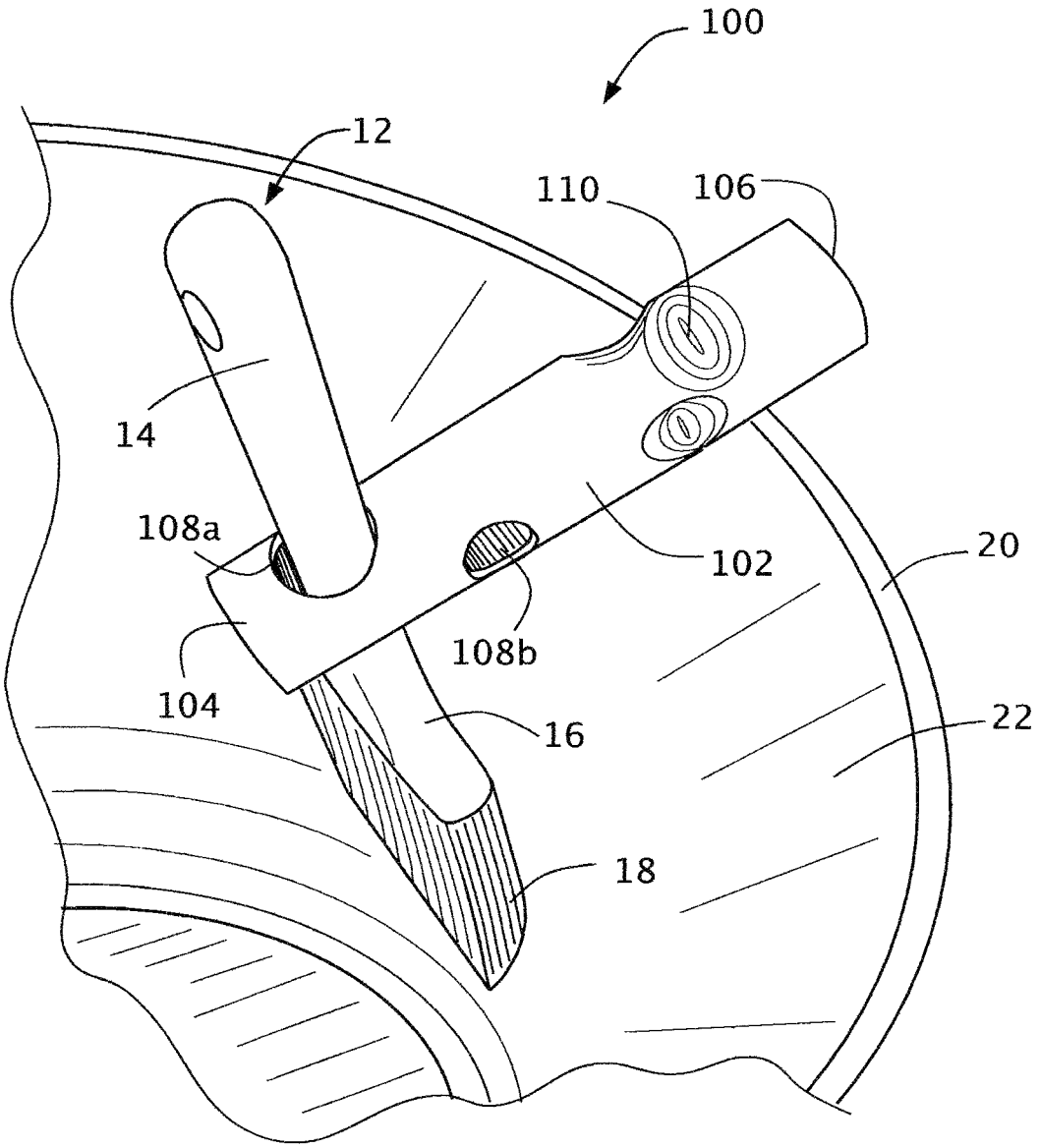
FIG. 3 shows another contemplated use of a paint brush holder in accordance with an embodiment.

Referring again to FIGS. 2A and 2B, in accordance with the present invention, the holder can further include a notch 110 located near the second end 106. In an embodiment, the notch 110 can comprise an excavation having a roughly V-shaped or U-shaped profile on the surface of the body 102. In another embodiment, the notch 110 can be the outer end of a bore penetrating the body 102. As shown in FIG. 3, the notch 110 can be used to hang the holder 100 and a brush 12 inserted therein, e.g. from the rim 20 of a paint bucket or pail 22, during an interruption in painting. An added benefit of this use is that any paint that may drip from the brush bristles can be caught in the bucket or pail, thus decreasing potentially wasted paint and mess.

Figure 4:
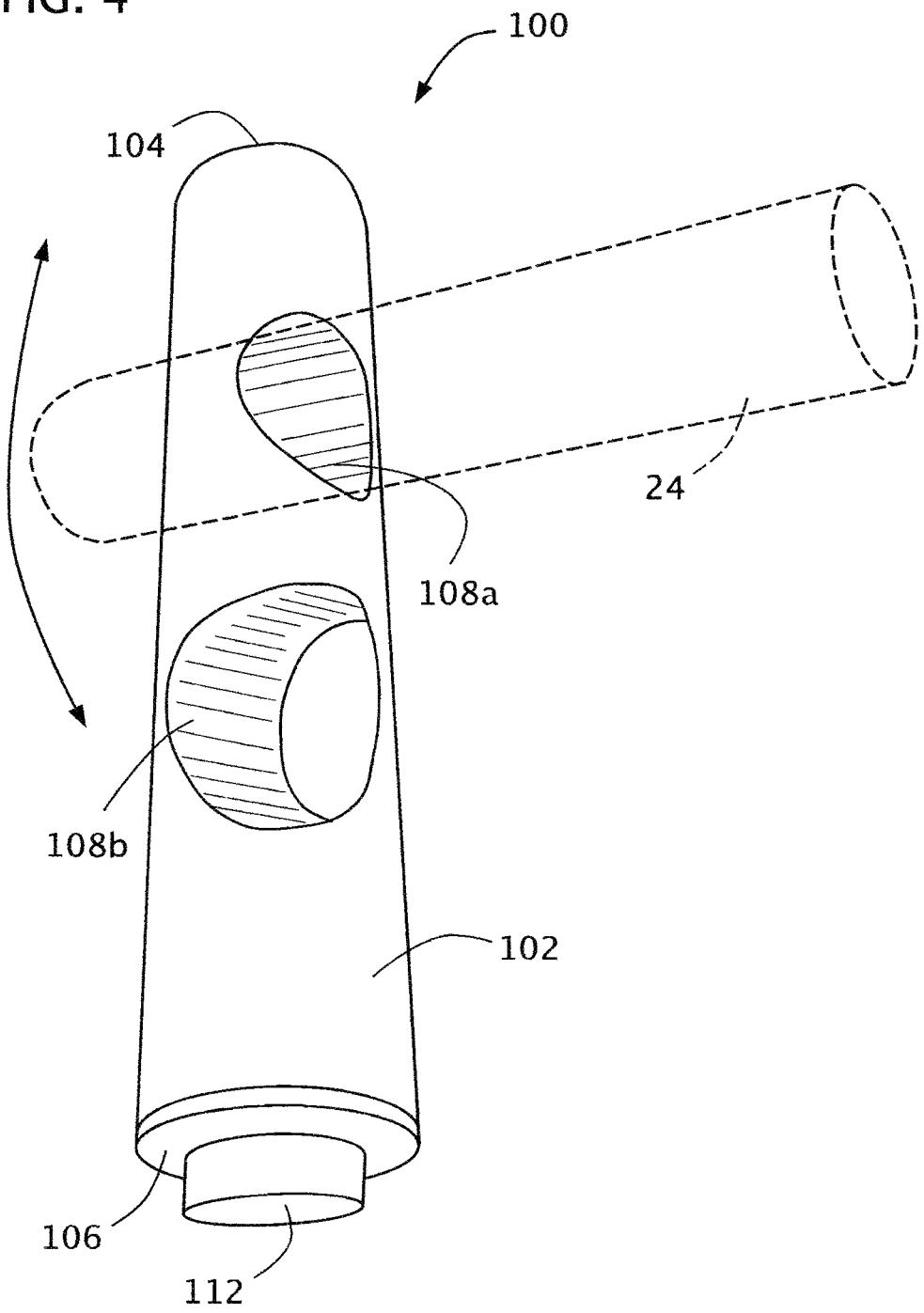
FIG. 4 is a perspective view of a paint brush holder including a hammer head in accordance with another embodiment of the present invention.

According to an embodiment of the present invention, the holder 100 can be configured for use as a tool for other tasks, such as for hammering. In a specific embodiment, as shown in FIG. 4, the holder can include a hammer head 112 attached to an end of the body (shown here at the second end 106). In a specific embodiment, the hammer head 112 can be removably attached to the end. As illustrated in FIG. 4, the hammer head can be utilized by using a suitably shaped object 24, e.g. a paint brush handle or a rod, inserted into a bore 108 as a handle for swinging the holder 100. Alternatively, the holder can simply be held in the hand for hammering.

The hammer head 112 can comprise any hard and tough material suited for impact. In a specific embodiment, the hammer head 112 can comprise a material such as iron, steel, aluminum, molybdenum. In a particular aspect, the diameter of the hammer head 112 can be substantially similar to the cross-sectional diameter of the body 102. In another aspect, the diameter of the hammer head 112 can be within about 75% and about 125% of the cross-sectional diameter of the body 102. The hammer head 112 can have any shape suitable for the intended use, such as generally elliptical and circular in particular, triangular, generally rectangular and square in particular, or non-rectangular polygonal forms having from 5 to 20 sides. In a particular embodiment, the hammer head 112 has substantially the same shape as the cross-sectional shape of the body 102.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A system for a holder and a paint brush, comprising a. a body having a shape and a first end and a second end, wherein the shape of the body is a cylinder;

b. a bore completely penetrating the body transversely near the first end, wherein the bore has a diameter allowing insertion of a paint brush handle, wherein the paint brush is inserted perpendicular to the body to reduce overall hand fatigue and enable a broad part of the paint brush to be brought into proximity to the body, wherein the paint brush is configured to move relative to the bore while the bore remains stationary during one or more painting intervals, wherein the bore has a continuous and uninterrupted inner surface; and c. at least one notch situated near the second end.

2. The system of claim 1, wherein the shape has a cross-section selected from the group consisting of: circular, elliptical, rectangular, triangular, or non-rectangular polygonal.

3. The system of claim 2, wherein the cross-section is circular.

4. The system of claim 1, further comprising a second bore completely penetrating the body transversely near the bore.

5. The system of claim 4, wherein the second bore is oriented at a nonzero angle with respect to the bore.

6. The system of claim 4, wherein the diameter of the bore and a diameter of the second bore are different.

7. The system of claim 4, further comprising at least one additional bore completely penetrating the body transversely near the second bore.

8. The system of claim 7, wherein a diameter of the additional bore is different from a diameter of the second bore.

9. The system of claim 1, wherein the bore is oriented substantially perpendicularly to a longitudinal axis of the body.

10. The system of claim 1, wherein the bore has an orientation such that a paint brush inserted therein extends at a right angle to a longitudinal axis of the body.

11. The system of claim 1, wherein the body comprises a material selected from the group consisting of: wood, aluminum, rubber, or plastic.

12. The system of claim 1, wherein the body is substantially hollow.

13. The system of claim 1, wherein the body is substantially solid.

14. The system of claim 1, further comprising a hammer head attached to the second end.

15. The system of claim 14, wherein the hammer head is attached to the second end.

16. The system of claim 14, wherein the hammer head has a shape selected from the group comprising: circular, elliptical, rectangular, triangular, or non-rectangular polygonal.

17. The system of claim 14, wherein the hammer head has a shape substantially similar to the cross-section of the shape of the body.

18. The system of claim 14, wherein the hammer head comprises a material selected from the group comprising: iron, steel, aluminum, or molybdenum.

19. The system of claim 14, wherein the hammer head has a diameter within about 75% and about 125% of a cross-sectional diameter of the body.

* * * * *